US006027568A

United States Patent [19]

Wallace et al.

[11] Patent Number: 6,027,568

[45] Date of Patent: Feb. 22, 2000

[54] APPARATUS FOR PROCESSING FASTENERS

[75] Inventors: John S. Wallace, Bloomfield; Charles M. Stempien, Walled Lake; Joseph A. Lopetrone, Sterling Heights, all of Mich.

[73] Assignee: ND Industries, Inc., Troy, Mich.

[21] Appl. No.: 08/661,962

[22] Filed: Jun. 12, 1996

[51] Int. Cl.[7] ..... B05C 5/00

[52] U.S. Cl. ..... 118/668; 118/669; 118/676; 118/677; 118/679; 118/324

[58] Field of Search ..... 118/668, 669, 118/676, 677, 324, 679; 427/10; 250/22

[56] References Cited

U.S. PATENT DOCUMENTS

| | | | |
|---|---|---|---|
| Re. 33,766 | 12/1991 | Duffy et al. | 427/195 |
| 2,425,652 | 8/1947 | Starkey | 117/17 |
| 3,155,545 | 11/1964 | Rocks et al. | 118/621 |
| 3,294,139 | 12/1966 | Preziosi | 151/7 |
| 3,344,769 | 10/1967 | Williams | 118/69 |
| 3,439,649 | 4/1969 | Probst et al. | 118/634 |
| 3,494,243 | 2/1970 | Kleinhenn | 85/1 |
| 3,592,676 | 7/1971 | From, Jr. et al. | 117/18 |
| 3,830,902 | 8/1974 | Barnes . | |
| 3,896,760 | 7/1975 | Duffy . | |
| 4,035,859 | 7/1977 | Newnom . | |
| 4,114,505 | 9/1978 | Loeser et al. . | |
| 4,114,564 | 9/1978 | Probst . | |
| 4,353,325 | 10/1982 | Argazzi | 118/683 |
| 4,366,190 | 12/1982 | Rodden et al. . | |
| 4,421,800 | 12/1983 | Schoenbrg et al. | 118/677 |
| 4,528,938 | 7/1985 | Neville | 118/711 |
| 4,652,468 | 3/1987 | Gould | 427/282 |
| 4,701,348 | 10/1987 | Neville | 427/57 |
| 4,760,493 | 7/1988 | Pearson | 361/218 |
| 4,779,559 | 10/1988 | Gould et al. | 118/301 |
| 4,842,890 | 6/1989 | Sessa et al. | 427/47 |
| 4,851,175 | 7/1989 | Wallace | 264/255 |
| 4,865,881 | 9/1989 | Sessa et al. | 427/181 |
| 4,888,214 | 12/1989 | Duffy et al. | 427/183 |
| 5,025,750 | 6/1991 | Sessa et al. | 118/69 |
| 5,078,083 | 1/1992 | DiMaio et al. | 118/308 |
| 5,090,355 | 2/1992 | DiMaio et al. | 118/681 |
| 5,141,375 | 8/1992 | Pollizi | 411/369 |
| 5,141,771 | 8/1992 | DiMaio et al. | 427/181 |
| 5,169,621 | 12/1992 | DiMaio et al. | 427/195 |
| 5,236,505 | 8/1993 | DiMaio et al. | 118/410 |
| 5,306,346 | 4/1994 | DiMaio et al. | 118/308 |
| 5,403,624 | 4/1995 | DiMaio et al. | 427/421 |
| 5,415,337 | 5/1995 | Hogan et al. | 427/96 |
| 5,679,160 | 10/1997 | Wallace et al. | 118/669 |

FOREIGN PATENT DOCUMENTS

| | | | |
|---|---|---|---|
| 8906757 | 7/1989 | WIPO | F16B 37/00 |
| 9317797 | 9/1993 | WIPO | B05D 1/12 |

*Primary Examiner*—Laura Edwards
*Attorney, Agent, or Firm*—Liniak, Berenato Longacre & White, LLC

[57] ABSTRACT

An apparatus and method for providing a masking, insulating and/or lubricating barrier coating on a portion of the threads and/or other surfaces of discrete objects such as fasteners utilizing a liquid coating material as provided. The present invention can selectively coat threaded and/or unthreaded surfaces of fasteners having odd shapes, deep threads and extended hubs. The fasteners are subsequently elevated and inverted onto a conveying system that moves them away from the area where the coating material is applied directly into a heat treatment device such as an oven in a continuous on-line process that does not require manual handling of the fasteners.

19 Claims, 3 Drawing Sheets

APPARATUS FOR PROCESSING FASTENERS

BACKGROUND OF THE INVENTION

The present invention generally relates to improved discrete parts, such as fasteners, having a useful barrier coating applied to a portion thereof and a method and apparatus for processing such parts with a coating material. More particularly, the invention relates to the deposition of liquid fluorocarbon or hydrocarbon type coating materials in a precise and continuous high speed manner onto selected surfaces of fasteners to form a masking insulating and/or lubricating barrier coating on the fasteners. A particular application of the invention is the application of liquid fluorocarbon coating material to the internal threads and possibly other surfaces of an odd shaped nut having a deep threaded central hub.

Metal parts such as fasteners are being increasingly exposed to electrodeposition paints, primers, and corrosion resistant materials. Recent advances in improving the corrosion resistance of automobile bodies and other like structures have made use of such formulations for the treatment of steel structural members standards in industry. Many fastening elements are attached to basic structural components prior to processing of such components with electrodeposited primers, paints, and rust inhibitors. Therefore, any exposed threads of the fasteners attached to such components may become contaminated and make it difficult or impossible to thread such exposed fasteners with a mating fastener for subsequent assembly. Any coatings applied to such fasteners to resist contamination must also be sufficient to resist splatter from the welding procedures that they may be exposed to as they are affixed to the structural components. The need, therefore, arose to develop a way of preventing contamination of these exposed fastener threads that would not substantially interfere with the ultimate performance of such fasteners.

The prior art proposed a variety of coating systems to attempt to solve the problem of resisting corrosion inhibitor build-up on the threads of fasteners. However, these prior coating systems all suffered from substantial drawbacks even when used to coat standard types of fasteners. This has led to the development of improved coating methods and apparatus utilizing liquid fluorocarbon coating materials, such as described in applicants' copending application Ser. No. 08/483,100 filed Jun. 7, 1995. Such new systems feature capabilities that have caused demand for such coatings on a wide variety of different types of fasteners and other discrete parts to continue to increase. The expanding popularity of such coatings has further compounded the challenges facing existing coating systems.

For example, there has been increasing demand in industry for providing coatings on various odd shaped fasteners to resist the build-up of electrodeposited paints, primers, and corrosion resistant materials. These fasteners include, for example, internally threaded fasteners with extended hub sections, internally threaded fasteners with rounded lead in sections between the top surface of the fastener and the threaded portion, fasteners having off center openings and fasteners that have significantly different top surfaces than bottom surfaces.

Further compounding the difficulties of depositing a suitable barrier coating on such fasteners has been an increase in the need to cover not just threaded portions of such fasteners, but also all or a portion of other surfaces such as lead in sections or top or bottom face portions of the fastener at the same time. Specifications requiring such extended coating coverage necessitate very precise control so that only certain predesignated portions of the threads and additional parts of the fastener are coated while the remainder of the fastener remains free of such barrier coatings.

The vast majority of prior art systems are incapable of accommodating irregular types or shapes of fasteners or achieving the coating of a combination of fastener surfaces described above. U.S. Pat. No. 4,842,890 to Sessa et al. discloses a method for coating fasteners with a powdered fluorocarbon material. This method, however, is restricted to coating fasteners that have a head and shank port ion and cannot accommodate either internally threaded fasteners or odd shaped fasteners.

U.S. Pat. No. 4,652,468 to Gould et al. discloses a process for high pressure impact coating of threaded openings of internally threaded fasteners with fluorocarbon materials such as Teflon®. The Gould process attempts to specifically avoid the deposition of coating material on any surfaces of the fastener other than the threads. The process requires a masking of the surfaces of a nut in order to restrict the coating material from being applied to any other surfaces of the nut.

This process is complicated and expensive because it requires a choked area for drawing in the excess coating material from the opening of the nut and necessitates indexing, masking, and removing excess material during the coating process in a manner that significantly slows processing speeds. Additionally, Gould does not teach a way of accommodating any odd shaped internally threaded fasteners.

U.S. Pat. No. 4,701,348 to Neville discloses a method of coating the threads of internally threaded fasteners. Neville requires a metering nozzle to be selectively introduced and removed from a succession of internally threaded fasteners. The reciprocating movement of the nozzle necessitates an indexing fasteners that stops the flow of fasteners each time coating material is being applied to any single fastener. This dramatically slows processing rates.

The Neville nozzle has an ultrasonic tip which is vibrated after the metering of a drop of coating material in order to explode the drop to cause a fine mist of the fluid suspension to be sent towards the threads of the nut. Due to the difficulty in metering identically sized drops and successions exploding in the exact same manner using an ultrasonic power source. This system often exhibits uneven coating of the fasteners. Additionally, the flat, continuous belt and nozzle construction of Neville do not allow odd sized fasteners to be processed, nor is the coating of any portion other than the threads of the fastener contemplated.

Published PCT International Application WO8906757 of Prittinen et al. discloses a method and apparatus for coating internally threaded fasteners with materials such as Teflon®. This invention provides an indexed flow of fasteners before an application device that introduces a reciprocating rotary probe into each fastener to be coated. In addition to being slow because of the indexing required, this device does not contemplate application of Teflon® materials to any surfaces other than threads the fastener. This system also lacks a supporting structure that can readily and easily accommodate various different types of odd sized fasteners.

Furthermore, most of the prior art systems identified above require post application heat treatment of the coated fasteners, such as by baking in an oven. None of these references describes any type of on-line device or method for efficiently and simply moving the coated fasteners from the application conveyor to a post application heating station, such as an oven. Instead these systems deposited coated fasteners into bins or racks which then had to be physically brought to an oven and manually unloaded. As can be readily appreciated, this process was very labor intensive.

It is, therefore, apparent that a need exists in the art for an improved apparatus and method of coating the threads and/or other portions of a wide variety of fasteners to prevent electrodeposition of paints or corrosion resistant materials and for an improved on-line system of transferring coated fasteners into a post application heating station.

SUMMARY OF THE INVENTION

It is, therefore, an object the present invention to provide an improved apparatus for the application of liquid masking, insulating and/or lubricating substantially pinhole free barrier coatings on discrete objects, such as fasteners, that overcomes the problems posed by prior art systems.

It is a further object of the present invention to provide an improved method and apparatus for providing a barrier coating on threaded or other surfaces of a succession of fasteners does not require the stopping of the feed of fasteners as they travel through the coating apparatus.

Another object of the present invention is to provide an improved method and apparatus for providing a barrier coating on the threaded or other surfaces of a fastener that features precise metering and control of the location of the deposition of the liquid material applied to the fastener.

Still another object of the present invention is to provide an improved method and apparatus for the application of a barrier coating onto the selected portions of fasteners that requires little or no preheating of the fasteners.

A still further object of the present invention to provide a method and apparatus for the application of a barrier coating of liquid material onto the threads of an internally threaded fastener that does not require a nozzle to be introduced into the threaded opening.

It is another object of the present invention to provide a method and apparatus for the application of a barrier coating onto the threads and/or other surfaces of fasteners that accommodates a wide variety of different types, sizes, and shapes of fasteners.

It is a further object of the present invention to provide a method and apparatus for the application of a barrier coating of liquid material onto a fastener that further provides an on-line mechanism for transferring the fasteners directly into a post application heat treatment device, such as an oven.

It is also an object of the invention to provide a method and apparatus for coating the threads or other portions of the fastener with a barrier coating at productions rates far faster than those obtainable in the prior art.

Yet another object of the present invention is to provide a method and apparatus for coating the threads of a fastener with a barrier coating that does not require rotation of the material applying element during the coating process.

It is yet another object of the present invention to provide a method and apparatus for coating fasteners with a barrier coating material that can easily accommodate either fasteners fed loosely or in a regularly spaced centered succession.

In one aspect of the invention, individual articles, such as non-uniform and odd shaped nuts, are deposited onto a continuously moving split conveyor belt in a spaced uniform orientation. The fasteners are continuously carried by the conveyor belt at a high rate of speed through a liquid material deposition area, where optical sensors trigger precisely metered discrete shots and/or atomized airless sprays of material onto specific locations of the fastener and/or the threads of the fasteners in order to form a barrier coating thereon. With the barrier coating material deposited on the fasteners, they are next conveyed through an optional cleaning station. The fasteners are then elevated and inverted by use of a magnetic wheel and subsequently transferred onto a conveyor which carries the fasteners away from the device and directly into a heated oven in order to stabilize the coating and vaporize the organic solvent contained in the coating material. The above and other objects will become apparent after reviewing detailed descriptions are achieved by utilizing the method and apparatus of coating fasteners of the present invention.

BRIEF DESCRIPTION OF THE DRAWINGS

The invention will now be described further in connection with the attached drawings wherein like reference numbers refer to corresponding parts throughout the several views of preferred embodiments of the invention wherein.

DETAILED DESCRIPTION OF THE INVENTION

While the present invention will be described particularly with respect to applying fluorocarbon or Teflon® type material to form a continuous substantially pin-hole free barrier coating on the threads and/or other surfaces of non-uniformly shaped threaded articles, it is to be understood that the present invention can be utilized to apply a variety of fluorinated ethylene propylene copolymers or other similar type materials such as silicones, waxes and petroleum greases. The present invention contemplates supplying the coating materials in a liquid form that contains a fine unpolymerized powdered material in an epoxy paint containing a fluid solvent.

Figure 5:
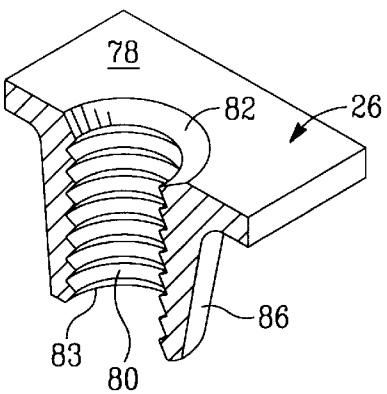
FIG. 5 is a partial crosssectional view taken along the line 5—5 in FIG. 4.
Figure 4:
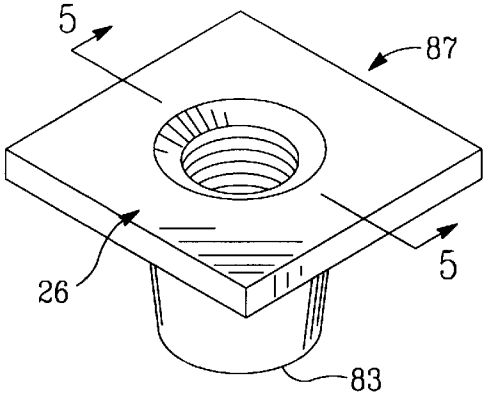
FIG. 4 is a perspective view of an exemplary fastener that can be processed in accordance with the present invention.

Additionally, while the invention contemplates providing coatings on a variety of discrete metal objects, threaded articles or fasteners including, but not limited to, nuts, bolts and similar articles, it will be described for exemplary purposes only with reference to a weld or cage nut having a central threaded opening such as is illustrated in FIGS. 4 and 5. Also, although the invention will primarily be described in connection with providing a coating on substantially all of the threads and the lead in area of a threaded fastener, it is also to be understood that such a coating could be placed on a limited number of threads and/or be provided on non-threaded surfaces if so desired.

Figure 1:
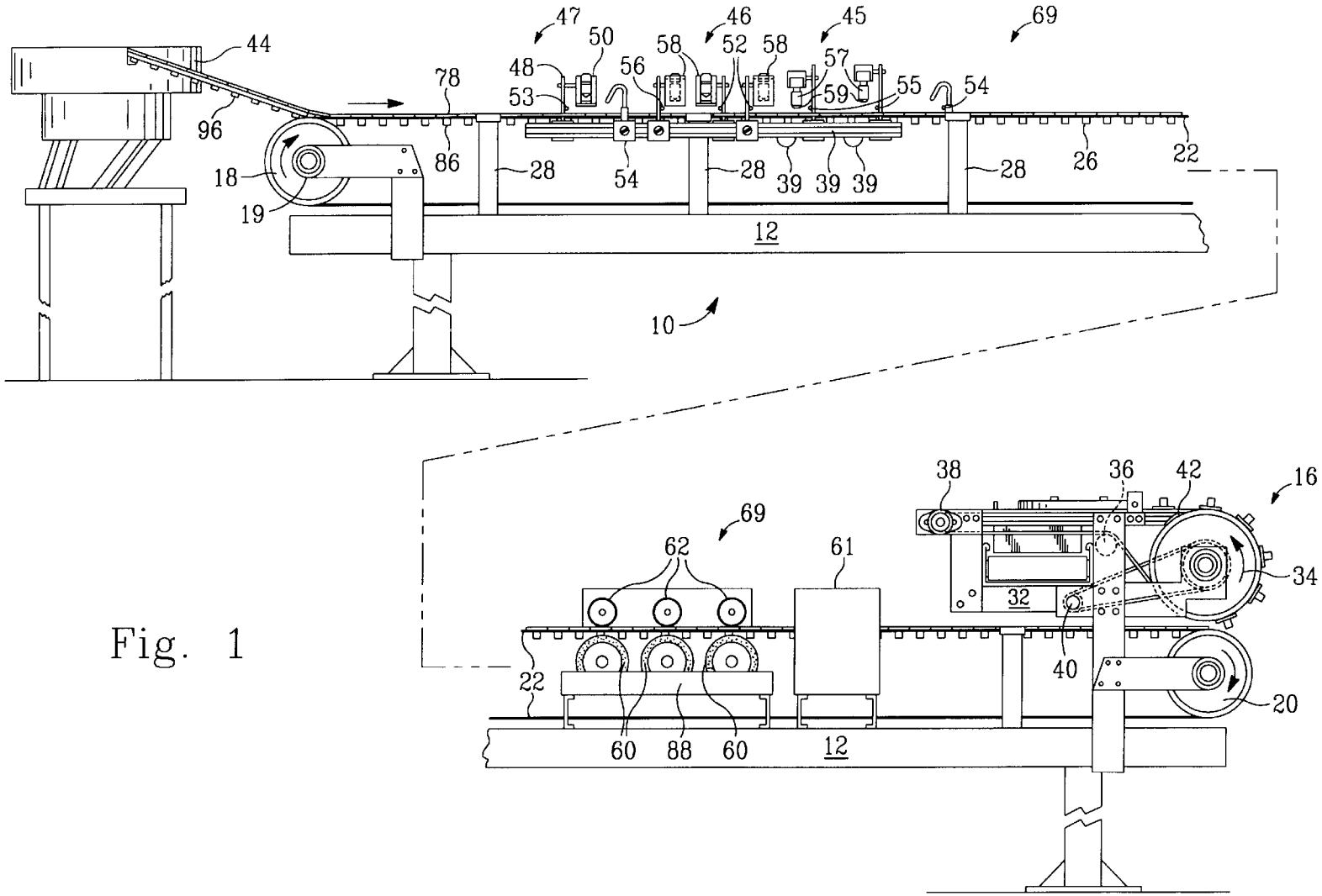
FIG. 1 is a side view of one embodiment of the present invention.
Figures 2, 3:
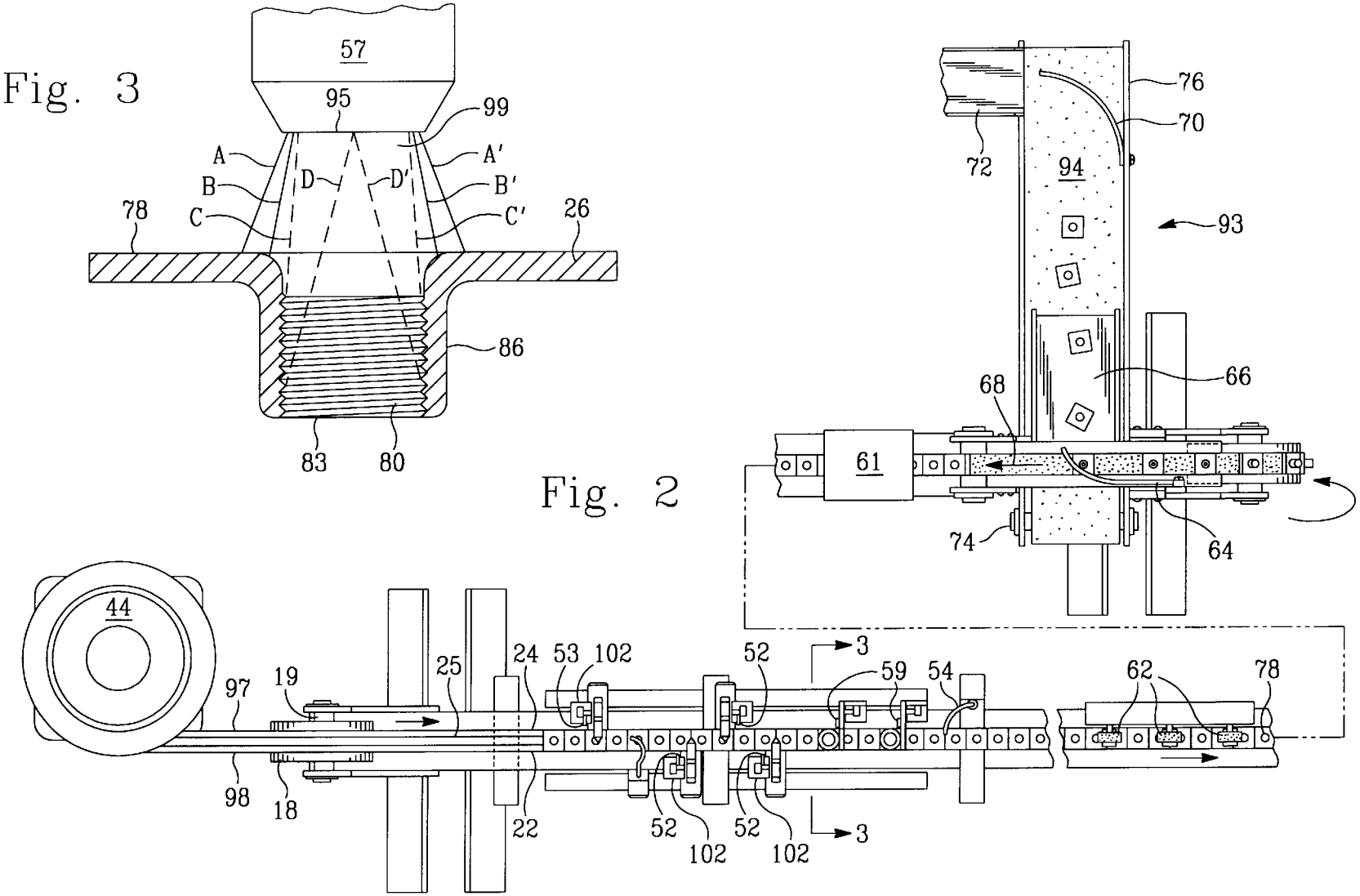
FIG. 2 is top view of one embodiment of the present invention.
FIG. 3 is a partial cross-sectional view taken along the line 3—3 of FIG. 2 of one embodiment of the present invention.

FIGS. 1 and 2 generally illustrate one preferred embodiment of the device 10 for practicing the present invention. The device 10 functions to achieve the process steps of the present invention. The barrier coating that is deposited by the device is substantially uniform. When deposited on the threads of a fastener, the fastener exhibits substantially uniform torque-tension curve behavior during coupling. The device 10 has a frame 12 that serves as a mounting base for a split belt conveyor system 14 and an inverting removal system 16. The removal system 16 is positioned so that one of its ends partially overlaps one end of the split belt conveyor system 14. The conveyor system 14 features front and back split style conveyor wheels 18 and 20 respectively that have two continuous spaced conveyor belts 22 and 24 running therebetween.

This belt construction leaves an open channel 25 between the two belts 22 and 24 and has been proven to be particularly effective in moving fasteners such as non-uniform nuts having deep threaded sections along the conveying system 14. The channel 25 is adjusted to be slightly larger than the outside diameter of the fastener and allowing the hub 86 to be centered between the belts 22 and 24. An example of such a fastener is indicated generally as 26 in FIGS. 4 and 5. Prior art single belt systems generally do not provide an adequate means for accommodating such fasteners, particularly where surfaces other than the threads of the fastener 26 also were desired to be coated.

The gravity force exerted on each fastener 26 on the conveyor system 14 tends to hold the bottom surface 87 of the fastener 26 in frictional engagement substantially flat against the top surface of the belts 22 and 24 causing the fasteners 26 to move continuously along the belt in a stable and fixed manner and at a consistent speed. No additional devices are needed to attach the fasteners 26 to the belts 22 and 24 during processing. The split belt conveyor system 14 has proven to be very effective in providing a continuous stream of fasteners 26 in a very consistent position, thereby enabling coating materials to be applied to the fasteners 26 while using very high belt speeds.

The conveyor system 14 carries fasteners 26 from a parts feeder 44 into and past an application station 46. The conveyor system 14 next carries the fasteners 26 through an optional excess material removal station 69 and an optional material fixing station 61. The conveyor system 14 then moves the coated fasteners 26 to an inverting removal system 16.

As will be described to follow in detail, the removal system 16 provides a unique on-line mechanism that first utilizes the attractive forces generated between the fasteners 26 and the magnetic conveyor wheel 34 to remove them from the downstream end of the belts 22 and 24 at the rear conveyor wheel 20. As the conveyor wheel 34 rotates, the fasteners 26 are elevated and subsequently inverted so that they are resting on their top surfaces 78 along a conveyor belt 68 moving in a direction opposite their original direction of travel when they were on the split belt conveyor system 14.

The fasteners 26 are subsequently removed from the conveyor belt 68 and are directed onto an additional conveyor 94 that moves the coated fasteners 26 away from the device 10 and directly into a heat treatment station such as an oven. The elevation and inversion of the coated fasteners 26 and direction of those coated fasteners onto a conveyor 68 that takes them away from the device 10 and directly into a heating system such as an oven all occurs in an on-line continuous fashion and does not require indexing or slowing of the split belt conveyor system 14.

Figure 6:
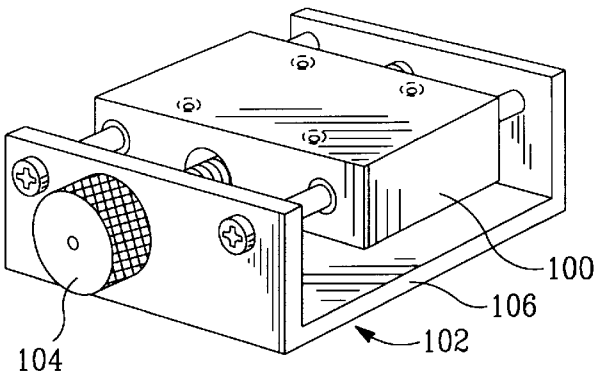
FIG. 6 is a perspective view of an adjusting sensor slide of one embodiment of the present invention.
Figure 8:
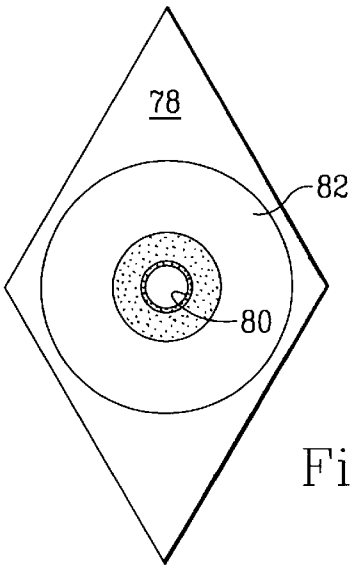
FIG. 8 is a top view of another fastener that can be processed in accordance with the present invention.
Figure 7:
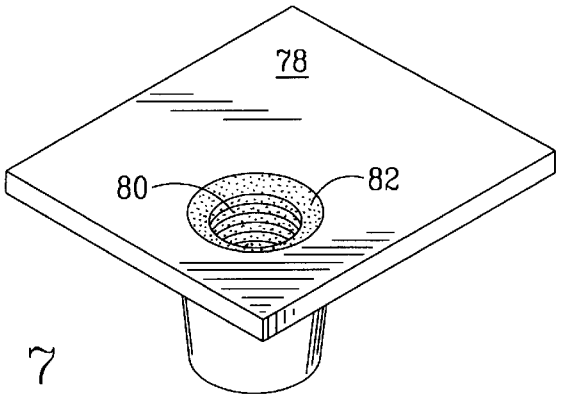
FIG. 7 is a perspective view of an other exemplary fastener that can be processed in accordance with the present invention.

A preferred embodiment of the present invention will now be described in detail by tracing the path of fasteners 26 through the device 10 with reference to FIGS. 1–6. This embodiment of the present invention will be described for exemplary purposes only in connection with fasteners such as cage or weld nuts that have a deep threaded central hub 86 as illustrated in FIGS. 4–5. As previously described, cage or weld nuts having a diamond or rectangular top surface and/or an off center opening, as illustrated in FIGS. 7–8, are likewise easily accommodated Referring particularly to FIGS. 1–2, the fasteners 26 to be processed by the device 10 are first ordered and aligned in a uniform orientation by a parts feeder 44. The parts feeder 44 can take many different forms that are well known in the art such as vibratory feed bowl mechanisms. Alternatively, the fasteners could be fed by hand to the split belt conveyor system 14. Once sufficiently ordered and aligned, the fasteners 26 are exited from the feeder 44 onto a track 96 that provides an angled delivery onto the conveyor system 14. The track 96 has a central gap 97 and two spaced rails 98. The gap 97 allows the enlarged hub 86 of the fasteners 26 to project below the surface of the rails 98. The rails 98 provide a support surface for the bottom 87 of the fastener top surface 78.

As mentioned above, the split belt conveyor system 14 has front and rear split style conveyor wheels 18 and 20 respectively that are mounted to the frame 12 of the device 10. The conveyor system 14 has two continuous conveyor belts 22 and 24 that run between the wheels 18 and 20 and provide a channel 25 between the belts 22 and 24. The wheels and belts can be readily removed from the device 10 and changed to enable the device 10 to accommodate different types of fasteners 26. Additionally, the width of the channel 25 between can be adjusted by either spreading the belts 22 and 24, or moving them closer together. The conveyor system 14 also provides blocks 28 spaced along the underside of the top surface of the belts 22 and 24 to provide support thereto and to maintain the belts 22 and 24 substantially straight and parallel to the frame 12 while conveying fasteners 26 from one end of the device 10 to the other.

The belts 22 and 24 can be constructed of a number of different materials, provided that they exhibit high strength and provide a non-stick surface. A particularly preferred material for the belts 22 and 24 has been found to be a stainless steel that is approximately 0.625" wide and approximately 0.032"–0.050" thick. As can readily be appreciated, belts having many different thicknesses and widths can also be utilized depending upon the particular fastener to be processed by the present invention.

A variable speed motor (not shown) is connected to the drive wheel 18 respectively and allows the speed of the belts 22 and 24 to be selectively adjusted to a desired consistent speed. Alternatively, the motor could also be connected to wheel 20. Depending upon the type of fasteners processed, the practical belt speed usually ranges from about 6 to about 30 feet/minute. These belt speeds enable production of 3,000 to more than 10,000 parts/hour by the present invention, depending upon the part, its shape and size.

As the fasteners 26 continue to move down the conveyor system 14 they next encounter an application area 46. The application of all liquid materials to the fasteners 26 is accomplished in the area 46. It is occasionally preferred to provide an optional heater along the conveyor system 14 to preheat the fasteners to about 100° F. to 150° F. prior to the application of any liquid materials. In certain limited instances, such preheating of the fasteners 26 may assist in the distribution of liquid material applied to the fasteners 26. An accessory rail 30 is mounted to one of the support blocks 28 to provide a point of attachment for the various components in the application area 46.

Prior to coating the fasteners 26, it is sometimes necessary to loosen surface oil or dirt from the threads 80 or other areas prior to any coating operation. To accomplish this purpose, as the fasteners 26 travel into the application area 46, they first encounter an optional on-line cleaning station referred to generally as 47.

The cleaning station 47 provides one or more guns such as gun 50. The gun 50 is mounted on a stage 48 that is capable of adjustment in at least two and preferably three different axes. This enables precise adjustment of the gun 50 to accommodate a wide variety of different types of fasteners 26 or other parts. The stage 48 is mounted at one end to the accessory rail 30. In certain preferred embodiments, the stage 48 is adjustable in only two axes—vertically and closer or further from the part. In this case, the optical sensor 53 described in detail below is mounted to the block 100 of an adjustable slide 102 as illustrated in FIG. 6. The base 106 of the slide is in turn connected to the rail 30. Side to side adjustment is then accomplished by turning the screw 104 to move the block 100 and sensor 53 connected thereto. Alternatively, multiple slides 102 could be stacked together to provide two or three axis adjustment.

Although a variety of different guns can be utilized for the purpose of metering precise high speed discrete shots of liquid material, a particularly preferred gun has been found to be a Nordson® Zero Cavity gun with a Number 276515 module manufactured by the Nordson Corporation of Norcross, Ga. Again, although a variety of different stages can be used, a particularly preferred stage has been found to be the 4500 Series ballbearing stage manufactured by the Daedal Division of the Parker Corporation of Harrison City, Pa.

The gun 50 is supplied with solvent from an off-line supply container (not shown). An optical sensor 53 is mounted to the rail in close proximity to gun 50. When the sensor 53 senses threads 80 or another predetermined portion of the fastener 26, it triggers a discrete shot of an appropriate type of rapid evaporating liquid solvent to be precisely delivered onto the threads 80 or other desired surfaces of the detected fastener 26. A particularly preferred sensor for this purpose has been found to be the model FX7 manufactured by Sunx Sensors Corporation. An alternative preferred sensor has been found to be the model no. PZ-101 manufactured by Keyance Corporation. Although a variety of different solvents can be used for this purpose, a particularly preferred solvent has been found to be methylethylketone (MEK). Once applied to the fasteners 26, the solvent is given a sufficient time to loosen any surface oil and dirt that may be on the threads 80 or other surfaces.

The conveyor system 14 next moves the fasteners 26 past the high pressure air blow off port 54. This port 54 is utilized to blow air into the threaded hole 80 thereby causing the solvent and loosened dirt and oil to atomize and be sharply blown out of and carried away from the now clean threads 80 of the fasteners. After exiting the cleaning station 47, the fasteners 26 are allowed some additional time for any solvent remaining on the threads 80 to dry prior to application of any coating material.

In the alternative, the gun 50 of the on-line cleaning station 47 can be used to deliver discrete shots of solvent such as N-methyl-pyrrolidone (NMP) onto the threads 80 or other portions of each detected fastener 26. In this situation, the blow off port 54 is not used to remove the solvent. Instead, the air pressure in the blow off port 54 is reduced so that it spreads the solvent evenly in the threads 80 of the fasteners 26 to act as a wetting agent and improve the wicking of subsequently applied liquid coating material.

As the fasteners 26 are carried further down the conveyor system 14, they next encounter a liquid material application station designated generally as 45. The application station 45 of the present invention is particularly designed for applying liquid coating materials to fasteners 26 that have odd shapes, deep threads, extended threaded portions, off center openings, or are otherwise particularly difficult to completely or partially coat. The station 45 is also designed for the application of liquid coating material to surfaces other than the threads 80 of a fastener 26, either alone or in combination with coating the threads 80.

Referring particularly to FIGS. 1 and 2, as previously described in applicants' copending application, Ser. No. 08/483,100 filed Jun. 7, 1995, one or more liquid applicator guns 58 may be provided for applying liquid coating material 99 such as a suspension of a fluorocarbon in a liquid solvent to successive fasteners as they pass by the guns 58. The entire disclosure of that copending application is incorporated herein by reference. Each of the guns 58 is attached to the accessory rail 30 of the device 10 by means of a stage 56. The stages 56 allow the guns 58 to be selectively positioned and subsequently be secured in fixed locations for the application of liquid coating material 99 to different size or shape fasteners 26.

Preferred stages 56 for use in connection with the present invention allow adjustment of each gun 58 along three different axes. The stages 56 enable the vertical distance between the guns 58 and the conveyor belts 22 and 24 the horizontal location of the guns 58 in relation to the center of the threads 80 with the angle and direction of the guns 58 with respect to the threaded hub 86 to be adjusted. The stages 56 may be used alone or in connection with one or more slides 102. Particularly preferred stages, slides and guns for use in connection with the present invention are the same as those described above in connection with the on-line cleaning station 47.

Once the fasteners 26 move into the liquid application station 45, the threaded hub 86 of each of the respective fasteners 26 is detected by photo-optic sensors 52. Although a variety of different optical sensors are capable of being utilized for this purpose, it has been found that a particularly preferred sensor for use in the present invention is the model no. PZ-101 manufactured by Keyance Corporation. Once the sensor 52 detects the presence of a fastener 26 and/or the threaded hub 86 thereof, it sends an electrical signal to its respective gun 58 which triggers the firing of a discrete shot of liquid coating material 99 onto a portion of the threads 80 of each fastener 26. Once deposited, the coating material 99 flows down the threads 80 toward the bottom 83 of each successive fastener 26.

As the fasteners 26 move past successive guns 58, additional discrete shots of coating material 99 are deposited circumferentially apart from the location of the first discrete shot of coating material 99 that has been applied to the fastener 26. By applying the discrete shots of liquid material in this manner, the material 99 wicks around the threads 80 of the fasteners 26 in a substantially even manner.

The location, speed and amount of material 99 that is deposited is controllable by the guns 58 acting in combination with the sensors 52 and stages 56. Depending upon the particular fasteners to be coated the minimum amount of liquid coating material 99 sufficient to wick around and cover all of the threads 80 or less than that amount is shot in totality into the threaded hub 86. By accurate positioning, metering and selecting the proper pressure of these discrete shots of liquid material 99 emanating from the guns 58 the material 99 can be substantially entirely confined within the threaded hub 86 if so desired.

The guns 58 are capable of delivering high speed accurate metered shots of a wide variety of liquid coating materials. These materials include, but are not limited to, fluorocarbons, hydrocarbon and fluorocarbon copolymers, silicones, waxes, petroleum greases, Teflon® and Teflon®-type materials. Two materials have been found to be particularly preferred for use in connection with providing masking, insulating and/or lubricating coatings on fasteners. The first is a mixture of about 70% by volume DuPont Teflon®-S(#954-101) liquid and about 30% DuPont T-8748 thinner. The second is a mixture of about 60–70% by volume Whitford XYLENE® 1661 dry film lubricant manufactured by Whitford Corporation of Frazer, Pa. and about 30–40% of a solvent mixture that contains about 60% N-methylpyrillidene (NMP) and about 30% Whitford XYLENE®. The guns 58 used in connection with the present invention preferably utilize a nozzle diameter and range from about 0.005" to about 0.040" and are supplied with coating material under pressure of about 30 lbs/inch$^2$.

It should be appreciated that it is possible to use a single gun 58 and a single shot of discrete material 99 in connection with the present invention or any number of additional guns 58 to deliver multiple discrete shots of material 99 onto fasteners 26. Additionally, as will be described in detail to follow, the present invention can coat fasteners 26 without the use of any of the guns 58. The guns 58 can be utilized to place discrete shots of material 99 on surfaces other than the threads 80 of the fasteners 26. It is preferred that the guns 58 be fully capable of applying at least 20,000 and preferably up to 50,000 discrete shots of material per hour.

The application station 45 is also provided with one or more airless spray guns 57. As previously mentioned, demand is increasing for providing coating material onto portions of multiple surfaces of fasteners at times also having unusual or non-standard shapes or configurations. One example of this is the fastener 26 with an extended threaded hub 86 as illustrated in FIGS. 4 and 5. Other examples include the fasteners illustrated in FIGS. 7 and 8 respectively. Also, it has become increasingly desired to cover either all or a very precise portion of non-threaded areas of fasteners 26 such as lead in areas 82 and/or top surfaces 78 alone or in addition to the threads 80.

In order to accomplish this purpose, one or more airless spray guns 57 are used in the present invention, either alone or in combination with one or more guns 58 as previously described. The airless spray guns 57 are mounted to the accessory rail 30 by means of stages 55. The stage 55 allows the gun 57 to be adjusted with respect to its vertical height over the fasteners 26 as well as its horizontal location with respect to the belts 22 and 24. In certain preferred embodiments, the stage 48 is adjustable in only two axes—vertically and closer or further from the part. In this case, the corresponding optical sensor 59 is mounted to the block 100 of an adjustable slide 102 as illustrated in FIG. 6. The base 106 of the slide is in turn connected to the rail 30. Side to side adjustment is then accomplished by turning the screw 104 to move the block 100 and stage 55 connected thereto. Alternatively, multiple slides 102 could be stacked together to provide two or three axis adjustment. The guns 57 use optical sensors 59 as previously described to sense when a fastener 26 or predetermined portion thereof is present and then send a signal to trigger operation of the gun 57.

Each gun 57 is provided with an adjustable nozzle 95 as best illustrated in FIG. 3. The spray pattern emanating from the nozzle 95 can be modified by changing the nozzle 95 to take the form of an annular ring of material 99 such as the area between A and B and A' and B' in FIG. 3. Alternatively, the nozzle 95 can be adjusted vertically to provide a variety of void free spray patterns such as coverage in the entire area between A and A', C and C' and D and D' for example. Whether used in connection with one or more guns 58 that fire discrete shots of liquid coating material 99 or alone the airless spray gun 57 of the present invention can be utilized to provide a continuous, substantially pin-hole free coating on all or a portion of the threads 80, the lead-in area 82, the top surface 78 or any combination of these surfaces. The spray gun 57 operates with the conveyor system 14 continuously moving the fasteners 26 thereby eliminating the need to index the fasteners and also close off or mask the areas to be coated.

The high pressure and precision of the gun 57 allows precise delivery of the material onto only the desired preselected surfaces of the fastener 26 and serves to minimize overspray. The material issues from the gun 57 precisely directed in an airless, high velocity, atomized blast. This blast causes the coating material to uniformly disperse along the desired fastener surface or swirl previously applied material around the threads 80 or other surface. The blast is caused by forcing liquid material in the gun 57 through small slits so as to form a high pressure vertex that is then forced through a small orifice. The resultant centrifugal force plus the sudden release of pressure causes the liquid material to atomize into a precise spray pattern. An optional vacuum system 39 may be located under the gun 57 to assist in urging coating material 99 emanating from the gun 57 into and through the extended hub 86 or to collect only excess coating material.

Although it should be understood that a variety of different guns and nozzles can be used in accordance with the present invention and achieve satisfactory results, a particularly preferred airless spray gun 57 is the Nordson Airless Spray Gun, Model No. A7A, manufactured by Nordson Corporation of Amherst, Ohio. A preferred nozzle 95 for use with the gun is manufactured by Deladan Corporation, Model No. WDA1, with an internal diameter of 0.011" with 45° and/or 70° of spray angle. The nozzle 95 is preferably attached to the spray gun 57 via an adaptor. Spray pressure is preferably a minimum of about 500 psi. In addition, although a variety of different stages 55 can be utilized as long as they provide adjustability in at least two different axes for the guns 57 a particularly preferred commercially available stage is the model 4574, manufactured by the Daedal Division of the Parker Corporation of Harrisburg, Pa.

In the spray pattern illustrated in FIG. 3 designated as C–C', the optical sensor 59 has triggered the nozzle 95 of the spray gun 57 to spray liquid coating material 99 onto the threads 80 of the fastener 26. This spray pattern is effective for coating both the lead in area 82 and the threads 80 of fastener 26. The proper nozzle 95 chosen for this application is a 70° nozzle. With the 70° nozzle, the liquid coating material 99 will be sprayed perpendicular to the surface of the threads 80. Part of the atomized liquid material 99 will be applied to the side of the threads 80 facing the airless supply gun 57. The under side of the threads 80 opposite to the spray gun 57 will be covered as a result of the turbulence of the atomized liquid material 99 caused by material contacting the sharp edge of the thread peak and the high velocity of material discharged. The excess of the atomized liquid material 99 will then wick to the root of the threads 80 where through the capillarity of the material it will join together and build an even pin-hole free film along all portions of the threads 80 of the threaded hub 86.

As is readily apparent, the spray patterns illustrated in FIG. 3 are exemplary only. The airless spray gun 57 can be utilized alone or in combination with one or more guns 58 as previously described to coat all or a portion of the threads 80 of a fastener 26 and/or other surfaces such as the lead in area 82 and top surface 78. The spray pattern issuing from the gun 57 and bounded by the lines D and D' is particularly useful for coating deep threaded hubs 86 of fasteners 26 when used in combination with the discrete shots fired by one or more guns 58. When used in this manner, the guns 58 deposit discrete shots of liquid coating material onto the upper threads of the threaded hub 86 while the airless spray gun 57 is utilized to deposit coating material onto the lower threads of the threaded hub 86.

Once the appropriate coating of material 99 is deposited on the fasteners 26 by one or more guns 57, alone or in combination with guns 58, the belts 22 and 24 of the conveyor system 14 carry the fasteners 26 away from the application station 46. During this period of time the applied liquid coating material 99 wicks around the threaded hub 86 and covers all of the threads 80 in a substantially even manner.

Once the fasteners leave the application station 46, the device 10 can be optionally provided with an excess material removal station 69. Due to the precise metering of the guns 58 and 57 at the application station 45 of the present invention, it has been found that an excess material removal station is generally unnecessary. If still desired, the removal station 69 can take many different forms.

An air blow off port 54 can be provided along the conveyor system 14 to direct pressurized air through the openings of the fasteners 26 to remove any excess coating material. If excess material has been applied to the fasteners 26, it is likely that as a result of gravity and/or use of the blow off port 54 that it will tend to build up at the bottom 83 of the threads 80 of the fastener 26. If this circumstance is discovered, then it can be easily alleviated using one or more blotter wheels 60.

These wheels 60 preferably take the form of soft foam wheels rotating underneath the fasteners 26. The wheels 60 contact and press lightly on the bottom of the fasteners 26 to remove and carry away any excess coating material. As the fasteners 26 contact the blotter wheels 60 they are further urged by pressure wheels 62 that simultaneously contact the top surface 78 of the fasteners 26. The pressure wheels 62 can optionally be constructed of an absorbent material in order to remove any excess material from the top surface 78 of the fasteners passing by the wheels 62.

It is generally preferred that the rotational speed of the blotter wheels 60 be synchronized with the speed of the belts 22 and 24 carrying the fasteners so that there is no wiping action on the surface of the fasteners 26. However, in certain applications it may be desirable to move the blotter wheels 60 asynchronously to affect wiping action on the bottom of successive fasteners 26. As the blotter wheels 60 rotate away from the belts 22 and 24, they become partially submerged in a tank 88 that contains a solvent such as MEK or a mixture of NMP and XYLENE®, which cleanses the blotter wheels 60 of any excess coating material between successive presentations of the same section of the blotter wheel 60 to successive fasteners 26.

Once any excess coating material is removed at the removal station 69, the conveyor system 14 next transports the fasteners 26 through an optional drying station 61 as illustrated in FIGS. 1 and 2. Although generally unnecessary, this drying station 61 can have one or more air blowers, heaters or combinations thereof. The heaters can take the form of infrared, radiant or induction heating elements. Vacuum ducts can also be provided in the drying section to draw solvent fumes away. The purpose of the drying station 61 is to accomplish sufficient flashing off of the solvent contained in the coating material 99 on the desired surfaces of the fasteners 26 to stabilize the coating.

Once the fasteners leave the material fixing station 61 they are next carried toward the end of the conveyor system 14. At that time they encounter the inverting removal system 16. As will be described in more detail below, the removal system 16 serves to continuously remove fasteners 26 from the conveyor system 14, elevate those fasteners 26 and invert them. The removal system 16 features a magnetic conveyor wheel 34 that is driven by a variable speed motor 40. A continuous conveyor belt 68 runs between the magnetic wheel 34 and another conveyor wheel 38. Although a variety of belts can be utilized, a preferred commercially available belt that has proven effective is the Fluorofab #100-27 Teflon® coated fiberglass belt (two inches wide by 27 mils thick made by Greenbelt). In operation the speed of the belt 68 can be adjusted utilizing a variable speed motor 40 so as to efficiently remove successive fasteners 26 from the conveyor belts 22 and 24 in a spaced uniform manner.

As the fasteners 26 reach the end of the conveyor system 14 their top surfaces 78 adhere to the belt 68 carried by the wheel 34 as a result of the magnetic attraction between the wheel 34 and the fasteners 26. The rotation of the wheel 34 causes the fasteners 26 along the belt 68 to be elevated. The elevation and subsequent inversion of the fastener 26 as they travel on the belt 68 around the wheel 34 enables clear and easy visual inspection of the bottom of each fastener 26. Inversion of the fasteners 26 also redirects any coating material 99 that may still be liquid and located near the bottom 83 of the threads 80 to be redistributed over the entire threaded surface.

Once the fasteners 26 rotate on the belt 68 substantially 180° around the wheel 34, they are completely inverted from their initial positions on the conveyor system 14 with their top surfaces 78 resting against the top of the belt 68. The belt 68 then carries the fasteners 26 away from the wheel 34 until they encounter a removal bar 64 mounted to the inverter frame 42. As illustrated in FIG. 2, the removal bar 64 extends across the belt 68 at a height that permits contact of the bar 64 with the external surface of the threaded hub 86 of the fasteners 26. In this manner the action of the fasteners 26 hitting the bar 64 is sufficient to break the frictional engagement between the fasteners 26 and the moving belt 68 and direct them down an incline slide 66.

The end of the slide 66 terminates above a continuous transverse conveyor belt 94 that runs at a preselected adjustable speed between the conveyor wheels 74 and 76. A preferred commercially available belt has been found to be an eight inch wide PVC 120 belt having a friction surface on both sides manufactured by Hytrol Conveyors, Inc. The transverse conveyor belt 94 moves the fasteners 26 away from the conveyor system 14. A directing bar 70 is provided along the conveyor belt 94 near the wheels 76 that is spaced at a vertical distance above the belt 94. This directing bar 70 operates similarly to the previously described removal bar 64 and contacts the external surface of the threaded hub 86 of the fasteners 26 to break the frictional engagement between the fasteners 26 and the belt 94.

The bar 70 subsequently moves the fasteners onto a ramp 72 that delivers the fasteners 26 in a continuous and even manner into an oven, other heating device or conveying system therefor. In this manner the inverting removal system 16 and transverse conveyor system 93 of the present invention serve to provide a fast and efficient on-line mechanism for removing coated fasteners from the application conveyor system 14 and into an oven or other heater without requiring additional material handling of the fasteners.

Alternatively, the bar 70 can be connected to a pneumatic cylinder or similar device. In this construction the bar 70 oscillates back and forth across the surface of the belt 94. The oscillation of the bar 70 results in the fasteners 26 being deposited across the entire width of the ramp 72 over time. In certain circumstances this has provided improved efficiency in subsequent over heating of the coated fasteners.

The following examples are given to aid in understanding the invention. It should be understood that the invention is not limited to the particular procedures or parameters set forth in those examples.

EXAMPLE I

M14 cage nuts similar to those illustrated in FIG. 7 were deposited with their opening centered over the space between the two belts of a conveyor system of an apparatus as generally illustrated in FIG. 1. The cage nuts were similar to those illustrated in FIG. 7 and were approximately 2 inches long, 1.5 inches wide and 5/16 inch thick. The nuts contained a protruded shoulder on one surface having a ¾ inch outer diameter, a chamfered opening and an off-center hole. The parts were continuously fed by a rotary bowl. The part were then inverted by means of a specially designed downtrack. The parts were then deposited onto two spaced parallel steel belts with their protrusions facing downward. The belts were approximately each ⅝ inch wide and 0.030 inches thick. The length of the top track of these conveyor belts was approximately 20 feet. The clearance or space between the belts was about ¾ inch.

The parts were then moved into the application area by the conveyor belts. The nuts then encountered two Nordson Zero Cavity guns with Nordson #276515 modules located on opposite sides of the belts. Each gun applied a single shot of liquid coating material to opposite sides of the bottom of the threaded opening. The pot pressure of the liquid material delivered to the fasteners was about 25 psi. The material applied to the nuts was delivered at room temperature and contained a mixture of about 66% Whitford XYLENE® 1661 high build purple dry film lubricant and about 33% of a solvent mixture containing N-methyl-pyrrolidone(NMP) and XYLENE®. The shots of material were triggered by a pair of Model No. PZ-101 sensors, manufactured by Keyance Corporation, mounted in close proximity to each of the guns.

The nuts with the coating material applied traveled a short distance down the conveyor belt and encountered a Nordson Airless Spray Gun Model No. A7A manufactured by Nordson Corporation of Amherst, Ohio, which deposited a third shot of material in a round circular pattern that covered the chamfer or lead in area of the top of the opening and all of the threads of the opening as well. The material was the same as deposited in the prior two shots. The gun delivering the third shot was mounted directly overhead the opening of the nuts. The coating material was delivered at a pressure of less than 500 psi. The nuts then traveled a short distance further down the conveyor system and encountered an air nozzle directly overhead of the threaded opening. The air issued from the nozzle was at a low pressure from a ¼ inch polyurethane tube and served to both assist the spreading of the material on the desired areas of the nuts and to remove any excess material. The nuts then encountered a series of absorbent upper and lower blotter wheels whereby when passing through these wheels any excess material that may have been on the undesired surfaces of the fastener were removed.

The parts next were removed from the conveyor system by an elevating and inverting conveyor system. A magnetic pulley was utilized that attracted the top surface of the parts from the split belt conveying system. Once the parts were attracted to the magnetic force of the conveyor wheel, the wheel rotated the parts to a point where their orientation was inverted from the position they occupied on the split conveyor system. The parts then located above the split belt conveyor system were moved approximately 2 feet until they encountered a wipe-off bar which sent the parts down a 1 foot long track that had a drop of approximately 8 inches. At the bottom of the track the parts encountered and moved by a transverse conveyor system about six feet away from the inverting removal system and the split belt conveyor system. The parts next encountered a reciprocating wipe-off bar that oscillated back and forth across the width of the transverse conveyor belt. By this motion, the parts were directed down a ramp to another transverse conveyor belt that led them directly into an oven. The parts were then baked and in an oven at about 350° for approximately 10 minutes. The result was a substantially pin-hole-free coating of material on the entire threaded surface of the nuts and the chamfer or lead in area of the protruded shoulder. The parts were coated in a continuous process at a rate of about 5,000 per hour. Total weight of the coating material applied was about 150 mg. The coating present on the nuts had a uniform appearance and was free of tears, runs and flaked areas. In addition, the cured coating was effectively damage resistant to prevent chipping or other coating removal during normal handling and shipping of the parts.

EXAMPLE II

Internally threaded nuts similar to those illustrated in FIG. 8 were deposited with their openings centered over the space between the two belts of a conveyor system of an apparatus as generally illustrated in FIG. 1. The nuts had a diamond shaped top surface with the distance between the small points of the diamond being approximately 2 inches and the distance between the longer opposite points of the diamond being approximately 3 inches in length. The nuts contained a central threaded aperture that was approximately ¾ inch deep and had an outer diameter of approximately ½ inch. The top surface of the nuts had a circular downwardly sloping lead in area between the top surface and the threads.

The parts were hand fed onto the split belt conveying system. The parts were then processed in exactly the same manner as indicated in Example I. The specification called for barrier coating material to be deposited on all of the threads of the fastener and along a precise portion of the rounded circular lead in portion illustrated in FIG. 8.

The process of the present invention was able to coat approximately 3,000 of the parts per hour with coating material and the resulting coating was precisely placed only on the desired portion of the lead in area and over all of the threads of the fastener. The coating present on the nuts had a uniform appearance and was free of tears, runs and flaked areas. In addition, the cured coating was effectively damage resistant to prevent chipping or other coating removal during the normal handling and shipping of the parts.

From these examples the benefits of the present invention can be seen in the high speed application of liquid barrier coating materials to the threads and/or other surfaces of a continuous stream of fasteners having odd-shapes or deep threaded hubs and subsequently delivering them directly into an oven or other heater using an on-line process that does not require any manual handling in a very precise manner.

Having thus described our invention, we claim:

1. An apparatus for applying masking, insulating and/or lubricating coating material on selected portions of a plurality of fasteners having an open threaded section, a flat surface and a lead in area between the flat surface and the threaded area comprising:

first continuously moving conveying means for supporting said fasteners;

means for introducing said fasteners onto a first end of said first conveying means;

airless spray means for selectively applying atomized flowable liquid coating material in an annular ring onto a predetermined portion of only the threads and lead in area of each of said fasteners with the top of said open threaded section substantially uncovered, said applying means being substantially centered over said first conveying means; and optical sensing means located along said first conveying means in communication with said applying means for sensing when a fastener is present before said applying means and for causing said applying means to apply a coating material onto said predetermined portion of each fastener.

2. The apparatus of claim 1 further comprising:

means for removing fasteners from a second end of said first conveying means, said removing means further including a magnetic conveyor wheel.

3. The apparatus of claim 2 wherein said removing means further comprises second conveying means for elevating and inverting said fasteners from the position they occupied on said first conveying means to a second position where the flow of said coating material applied on said fasteners reverses and said flat surface of said fasteners is in contact with said second conveying means.

4. The apparatus of claim 3 further comprising:

means for contacting and removing said fasteners from said second conveying means.

5. The apparatus of claim 4 further comprising:

third conveyor means located under and substantially perpendicular to said second conveying means for directing said fasteners away from both said first and second conveying means.

6. The apparatus of claim 5 further comprising:

means located in the path of said fasteners for directing said fasteners off of said third conveying means.

7. An apparatus for applying masking, insulating and/or lubricating coating material on selected portions of a plurality of fasteners having oppositely disposed first and second surfaces and internally threaded openings with first and second ends comprising:

first continuously moving conveying means for supporting a first surface of each of said fasteners, said first conveying means comprising two spaced parallel belts with said internally threaded openings of said fasteners positioned between said belts;

means for introducing said fasteners onto a first end of said first conveying means;

first means for selectively applying flowable liquid coating material through said first end of each of said threaded openings onto only a first predetermined portion of the threads of each of said fasteners, said first applying means being located along said first conveying means;

first optical sensing means in communication with said first applying means for sensing when a fastener is present before said first applying means and for causing said first applying means to apply liquid coating material only on said predetermined portion of the threads of each fastener sensed;

second airless spray means for selectively applying an annular ring of atomized flowable liquid coating material onto only a second limited previously uncoated predetermined portion of each of said fasteners, said second applying means being centered between said two spaced parallel belts; and second optical sensing means in communication with said second applying means for sensing when a fastener is present before said second applying means and for causing said second applying means to apply coating material onto a second limited predetermined portion of each fastener sensed.

8. The apparatus of claim 7 further comprising means for applying a solvent and means for redistributing the solvent applied to the fasteners, said solvent applying means and redistributing means being located along said first conveying means prior to said first applying means.

9. The apparatus of claim 7 further comprising second conveying means that removes said fasteners from said first conveying means and inverts said fasteners and third conveying means located under and substantially perpendicular to said second conveying means for directing said fasteners away from both said first and second conveying means.

10. The apparatus of claim 9 further comprising means for removing excess coating material from said fasteners located along said first conveying means that contacts said fasteners.

11. The apparatus of claim 10 further comprising means for drying said liquid coating material located along said first conveying means after said first applying means.

12. The apparatus of claim 9 further comprising means located in the path of said fasteners for directing said fasteners off of said third conveying means and into an oven.

13. The apparatus of claim 12 wherein said means for directing said fasteners continuously reciprocates across the width of said third conveying means.

14. The apparatus of claim 7 further comprising means for preheating said fasteners located along said first conveying means prior to said first applying means.

15. The apparatus of claim 7 further comprising:

first means for mounting said first optical sensing means, said first mounting means being adjustable in two axes and being located along said first conveying means before said first applying means; and second means for mounting said second optical sensing means, said second mounting means being adjustable in two axes and being located before said second applying means along said first conveying means.

16. The apparatus of claim 7 wherein said first and second mounting means each further comprise an adjustment mechanism that permits adjustment in three different axes.

17. The apparatus of claim 7 further comprising second conveying means including a conveyor belt that supports said second surface of said fasteners and magnetic wheel means for removing said fasteners from said first conveying means and simultaneously elevating and inverting said fasteners on said conveyor belt to a point where said second surfaces of said fasteners are maintained against said conveyor belt by the force of gravity, said second ends of said threaded openings are visible and the flow of said liquid coating material applied to said first and second predetermined portions of said fasteners reverses.

18. An apparatus for applying masking, insulating and/or lubricating coating material on selected portions of a plurality of fasteners having oppositely disposed first and second surfaces and internally threaded openings with first and second ends comprising:

first continuously moving conveying means for supporting a first surface of each of said fasteners;

means for introducing said fasteners onto a first end of said first conveying means;

first means for selectively applying flowable liquid coating material through said first end of each of said threaded openings onto only a first predetermined portion of the threads of each of said fasteners, said first applying means being located along said first conveying means; and second conveying means including a conveyor belt that supports said second surface of said fasteners and magnetic wheel means for removing said fasteners from said first conveying means and simultaneously elevating and inverting said fasteners on said conveyor belt to a point where said second surfaces of said fasteners are maintained against said conveyor belt by the force of gravity, said second ends of said threaded openings are visible and the flow of said liquid coating material applied to said first and second predetermined portions of said fasteners reverses.

19. The apparatus of claim 18 wherein said first conveying means further comprises two spaced parallel belts with said internally threaded opening of said fasteners positioned between said belts.

* * * * *